US005125656A

United States Patent [19]

Fabanich

[11] Patent Number: 5,125,656

[45] Date of Patent: Jun. 30, 1992

[54] BOWLING BALL

[76] Inventor: John P. Fabanich, 4301 Colorado Ave., Sheffield, Ohio 44054

[21] Appl. No.: 816,258

[22] Filed: Jan. 3, 1992

[51] Int. Cl.[5] ..... A63B 37/06

[52] U.S. Cl. ..... 273/63 E; 40/327

[58] Field of Search ..... 273/63 E, 63 R, 63 A, 273/63 B, 63 C, 63 D, 63 F, 63 G; 40/327

[56] References Cited

U.S. PATENT DOCUMENTS

| | | | |
|---|---|---|---|
| 4,121,828 | 10/1978 | Amburgey | 273/63 E |
| 4,320,899 | 3/1982 | Salvino | 273/63 E |
| 4,913,429 | 4/1990 | Fabanich | 273/63 E |
| 5,074,553 | 12/1991 | Pawlowski | 273/63 E |

*Primary Examiner*—George J. Marlo

*Attorney, Agent, or Firm*—Gustalo Nunez

[57] ABSTRACT

A bowling ball wherein a core member includes a top weight member, two axis weight members, all generally lying in the same plane, and at least one leverage weight member. The leverage weight member is located generally adjacent one of the axis weight members. The top weight member and axis weight members are generally of uniform size and similar geometric structure. The leverage weight member is smaller in size with respect to the top weight member and the axis weight members. An outer shell member encapsulates the core member, top weight member, axis weight member and the leverage weight member. The core member is located generally near the geometric center of the outer shell member, said location determined by the weight desired at the top of the ball.

10 Claims, 7 Drawing Sheets

BOWLING BALL

FIELD OF THE INVENTION

This invention relates to bowling balls having a weighted core including at least one outwardly extending leverage weight for giving the ball more direction, trajectory and more power at point of impact.

DISCUSSION OF THE PRIOR ART

Bowling is a sport that has been with us for hundreds of years which is even chronicalized in the tales of Rip Van Winkle. Bowling is a sport in which the number of persons participating is continually increasing as evidenced by the construction of mammoth bowling palaces. Generally speaking the bowling ball has a thumb hole and two finger holes; however, this can vary depending upon the requirement of the user. Throughout the years, bowling enthusiasts have been attempting to design bowling balls that have intensified penetration upon impact with the pins, thereby increasing the pin action which results in more strikes and higher scores. However, when designing bowling balls one must meet certain size and weight requirements as dictated by the American Bowling Congress; i.e., the ball circumference between 26.704 inches and 27.002 inches, the ball diameter between 8.500 inches and 8.595 inches, and a weight of not more than 16 pounds 13 ounces. After the drilling of the finger and thumb holes, the maximum weight of the ball should not be greater than a gross weight of 16 pounds, 3 oz. top weight, 1 oz. left to right or 1 oz. front to back. Most balls are manufactured such that the bowling ball is formed by a core material encased by a continuous outer shell which is generally spherical in configuration.

Throughout the history of the sport, bowlers have attempted to design a "dream" ball, i.e. one which can increase one's score dramatically. This can only be done with a ball that can be thrown accurately, that will stay on track while rolling, and one which has dramatic pin mixing characteristics.

For example, Amburgey, U.S. Pat. No. 4,121,828 provides a bowling ball in which a disk core is positioned within the ball and disposed normal to the rolling axis thereof. A top weight is arranged within the outer marginal edge of the disk core in underlying relationship with respect to the finger holes. The mass of the top weight is greater than the mass of the disk. With this configuration, according to Amburgey, the ball is stabilized such that the ball travels down the alley in an improved manner and, upon impact with the pins, is not deflected.

Salvino, U.S. Pat. No. 4,320,899 attempts to solve the problem of an unstable ball by the use of a pair of weight blocks which are provided internally in the ball to compensate for the weight list because of the drilling of the finger and thumb holes. The weight blocks are positioned so as to be intersected by the finger and thumb holes when drilled. This results in a ball that exhibits stability without wobble when rolling down the alley.

The applicant, in U.S. Pat. No. 4,913,429, designed a bowling ball which met many of the characteristics of a "dream" ball. The ball was provided with a core which includes a top weight and a pair of outwardly extending axis weights. The combination of the weights provides a ball that has more accuracy, smoother rolling and increased pin action.

In the instant application, the applicant has now gone further in the design of a bowling ball that is engineered for specific alley conditions, i.e. heavy oil, average oil and short oil.

SUMMARY OF THE INVENTION

In accordance with the present invention, there is provided a bowling ball having a core member and an outer shell completely encasing the core member. The structural configuration of the core is unique. The core is formed of a material having relatively high density, a material such as barium oxide. The core, although one complete integral member, may be described as including a plurality of components. The center core is generally spherical in configuration and integral thereto, at the top portion thereof, in an upwardly extending frusto-conical weight, also referred to as top weight member, and two generally frusto-conical weight members sometimes referred to as axis weight wing members, extending outwardly at each side of the center core member and having generally the same longitudinal axis. The longitudinal axis of the top frusto-conical weight member is generally normal to the longitudinal axis described by the two outwardly extending frusto-conical weight wing members and wherein both longitudinal axes lie in the same plane.

The top frusto-conical member provides a top weight to the ball wherein the top weight will rotate in a plane which is parallel to the plane defined by the track of the ball.

The bowling ball contemplated herein is further provided with more than one leverage weight. The leverage weights are located at strategic positions on the core, which will be described in the detailed description of the invention. The leverage weights are designed such that additional weight can be provided to the outer surface portion of the ball or to the inner portion of the ball, all this being accomplished without changing the overall weight of the ball which is forbidden by the American Bowling Congress. The characteristic of having more weight at the outer surface of the ball provides better impact and the characteristic of having more weight towards the center of the ball provides a smoother rolling ball. The number of leverage weights to be applied to the center core is determined by the conditions of the alley upon which the ball will be used. This invention provides a bowler with a bowling ball designed for the particular alley conditions. It also provides a ball which can be drilled for left-handed and/or right-handed bowlers. Thus, the invention obviates the necessity of having two types of ball inventory for left-handed and right-handed bowlers.

The bowling ball construction contemplated in the instant application is for a bowling ball which is designed and manufactured for certain alley conditions such as heavy oil, average oil and short oil. This is accomplished by rotating the inner core member about a reference point, in this instance, a trademark symbol which is imprinted on the topside of the bowing ball during construction. Also, additional weight members, referred to as leverage weights, are strategically placed on the inner core. The locations of the leverage weights are also determined by the type of alley condition for which the bowling ball is being designed. The leverage weights are frusto-conical in configuration and have extending arms at each end thereof which are implanted into the core member at designated locations. The leverage weights are positioned on the core prior to setting the assembled core into the mold. The leverage weights, depending on the location, can also be used as drive weights and axis weights. The design of the leverage weights permits them to be reversed, depending on the type of ball and the type of roll desired such that extra weight can be placed towards the outer shell of the ball or towards the center of the ball. These features will be further explained in the detailed description of the invention.

The bowling ball to be specifically described in the detailed description is a bowling ball which provides the following: good finger weight, good thumb weight, good negative and positive weight, good revolution weight, good side axis weight and good center weight and good top weight. These features give the ball an exceptionally positive trajectory, less deflection, methodical penetration and a ball which has maximum pin action.

The uniqueness and the advantages of the presnt invention will become readily apparent to those skilled in the art upon reading the following detailed description and claims and by referring to the accompanying drawings.

DETAILED DESCRIPTION OF THE PREFERRED EMBODIMENT

Figure 3:
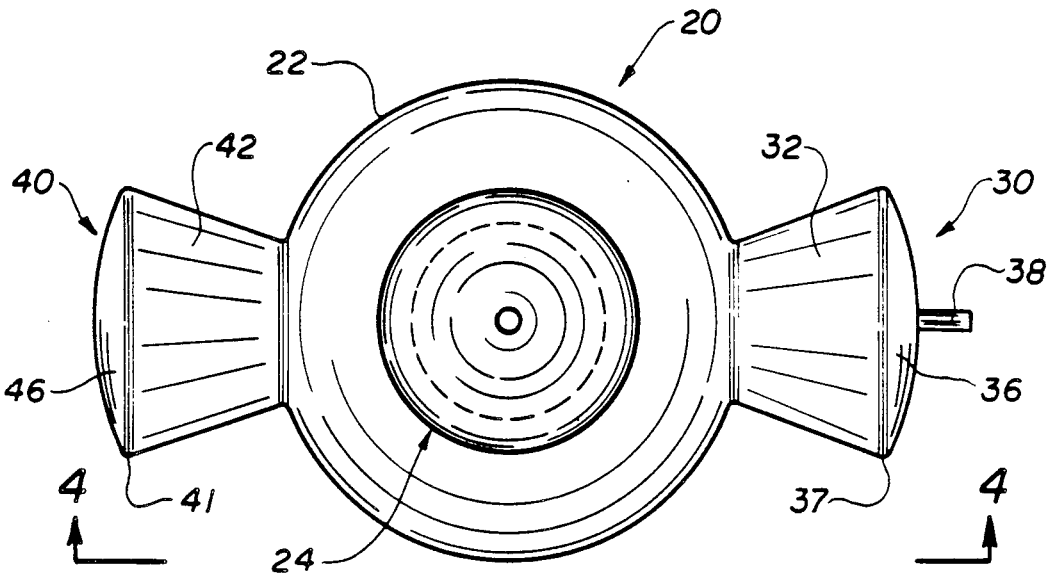
FIG. 3 represents a top view of the bowling ball core insert used in the present invention.

In the figures shown in the drawings, like or similar numerals, wherever logical or practical to do so, relate to like or similar elements. Although three embodiments of a bowling ball are to be described herein, each embodiment utilizes the same core member having a top weight and two opposing side axis weights. The core member illustrated in FIGS. 3, 4 and 5 is used in all of the embodiments.

Figure 1:
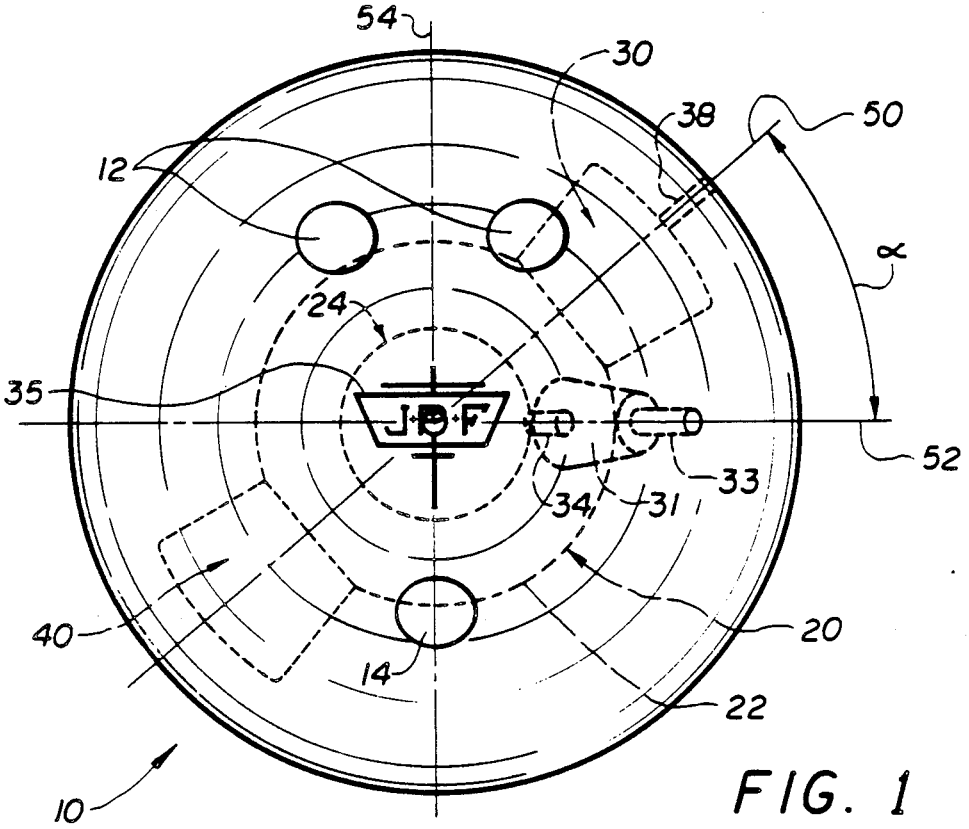
FIG. 1 represents a top view of a bowling ball with a bowling ball core insert including one leverage weight shown in cross-sections.

Referring now to the embodiment shown in FIG. 1, there is illustrated a bowling ball 10 having a thumb hole 14 and two finger holes 12. Also shown on the bowling ball 10 is a trademark 35 which is used as a reference point whose purpose will be explained later in this specification. The bowling ball 10, in order to meet the specifications of the American Bowling Congress, must have a circumference between 26.704" and 27.002" and a diameter of between 8.500" to 8.595". Further, the ball cannot weigh more than 16 pounds 3 oz. prior to drilling. The hardness of the bowling ball shell should be a minimum of 72, on a Durometer scale. The composition of the material used to form the outer shell may be plastic, rubber, polyester or urethane or any non-magnetic material. The bowling ball outer shell, in and of itself, forms no part of the present invention and will not be described in any kind of detail. The bowling ball contemplated in this invention is a two part ball, however, it can be fabricated as a three part ball or as a four part ball. Also, the bowling ball 10 has a positive side and negative side, with the positive side being the side closest to the bowler. A front and back weight adjustment may be required prior to pouring in the mold.

Figure 4:
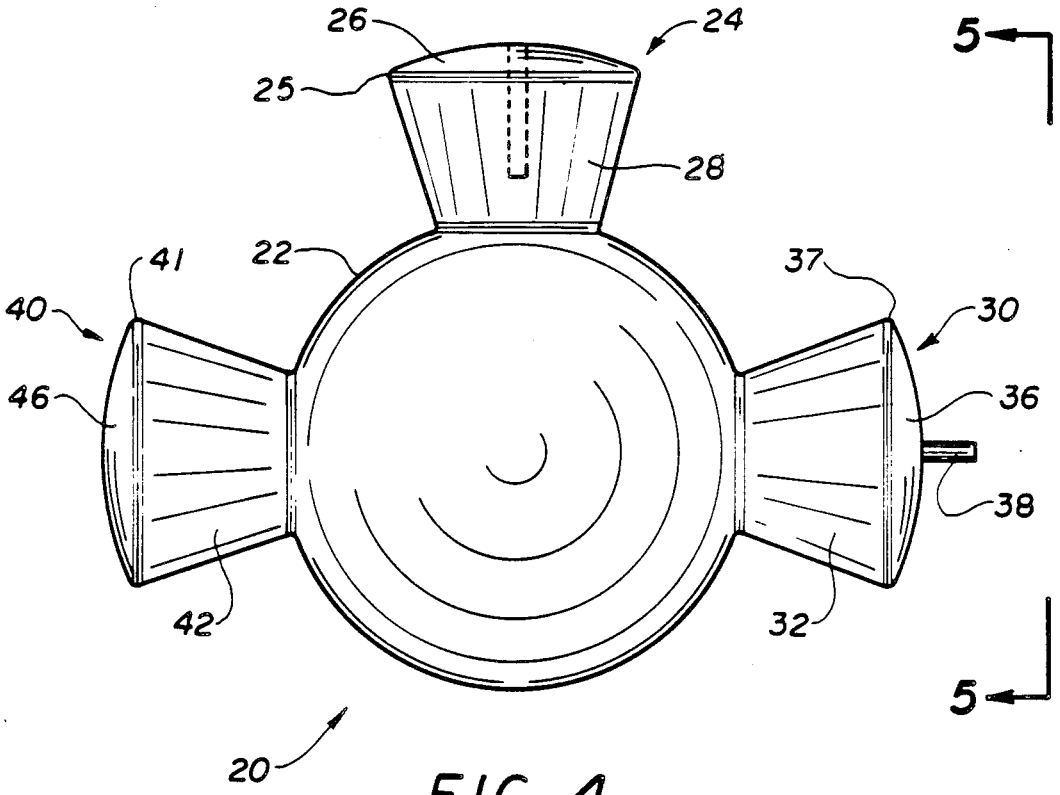
FIG. 4 represents a front view of the bowling ball core insert shown in FIG. 3, taken along line 4—4.
Figure 5:
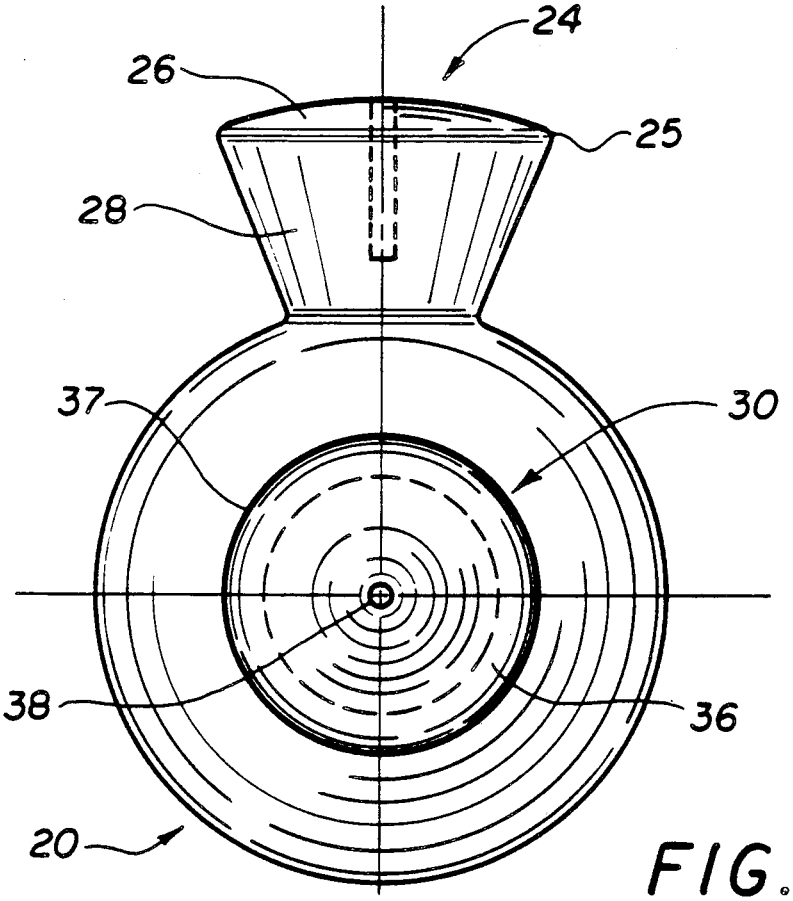
FIG. 5 represents a side view of the bowling ball core insert shown in FIG. 4 taken along line 5—5.

According to the present invention, located inside the bowling ball 10 is a complete core member 20 which includes a spherical member 22 and one top outwardly extending weight member 24, (as shown in FIG. 4). This extending top weight member 24 is frusto-conical in configuration, i.e., it resembles an outwardly extending cone, with one end thereof being integral to the sphere 22 and at the other end thereof, terminating at an edge 25. The frusto-conical member 24 terminates in the configuration generally resembling a segment portion of a sphere, or said in another way, describing a convex surface 26. The frusto-conical member 24 being further defined by an outside wall surface 28. A frusto-conical configuration can also be described as an elongated cone-type cylinder having at one end, a diameter greater than the diameter at the other end, and in which the diameter increases at a constant rate. The weights of weight members 20, 30 and 40 may be increased or decreased depending on the type of ball required.

Again, using FIG. 4 as our reference figure, there is located on one side of the sphere member 22 an outwardly extending axis weight member 30 which for purposes of explanation will also sometimes be referred to as the pin side member for reasons which will soon become evident. Said axis weight wing member 30 appears to resemble an outwardly extending elongated frusto-conical member, (FIG. 4), generally similar in construction to top weight member 24. The axis weight member 30, which is integral to the sphere 22, is capped at the end away from sphere member 22, with a convex surface 36, beginning at edge 37, which can also be described as a segment portion of a sphere. The axis weight member 30 is further defined by an outside wall surface 32. Located on the convex surface 36 is a pin 38, which is often used during the process of manufacturing the bowling ball 10.

Located on a side opposite pin side member 30 is a second outwardly extending axis weight wing member 40. Said axis weight wing member 40, like said first axis weight member 30, appears to be an elongated frustoconical member in configuration, generally identical to axis weight member 30. The axis weight member 40, also integral to the sphere 22, is capped at the end away from sphere member 22, with a convex surface 46 beginning at edge 41. Axis weight wing member 40, is further defined by an outside wall surface 42. The extending weight members 24, 30, and 40, are all generally fixed in the same plane as can be seen in FIG. 3 and can be designed similar to weight (FIG. 10) member 31. What has been described heretofore is the basic core member 20 which is common to all of the embodiments of the bowling ball contemplated by this invention.

Generally speaking, the alleys used in bowling can be classified into three categories, heavy oil conditions, average oil conditions and late roll conditions. The ideal bowling ball is one that would function the same under all three conditions; however, such is not the case. The first embodiment to be described is a bowling ball designed for heavy oil conditions.

Figure 10:
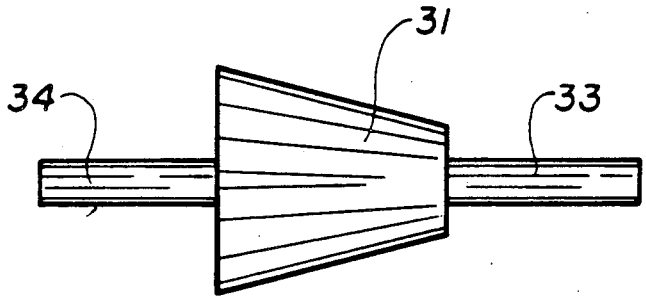
FIG. 10 is a side elevation view of a typical weight, used for leverage, power drive or axis weight depending on location.

Referring to FIG. 10 there is illustrated a weight member designated as leverage weight member 31 terminating at each end thereof with pin shaped members 33 and 34. Located on the core member 22 is an aperture (not shown) designed to receive and retain either of the pin members 33 or 34. Leverage member 31 is cone shaped having a diameter at one end smaller than the diameter at the other end, similar to the weight members 26, 30 and 40. The weight member 31 in this embodiment is positioned (refer to FIG. 2) immediately adjacent axis weight member 30 in a horizontal plane and approximately midway between the top weight member 24 and axis weight member 30.

Referring again to the bowling ball 10 shown in FIG. 1, at the centermost top portion of the ball is illustrated the mark JPF enclosed by a rhombus type symbol 35. The longitudinal axis of the rhombus 35 defines a plane which is coincident with the plane defined by the longitudinal axis of leverage weight 31 as shown by horizontal line 52. The rhombus enclosure 35 positioned on the outside surface of the bowling ball 10 is in alignment with the top portion of the top weight 24. The positioning of the rhombus 35 and the leverage weight member 31 determines the general position of the location of finger holes 12 and thumb hole 14. Generally, the finger holes 12 are equally distant from line 54 which is perpendicular to horizontal line 52 and positioned such that it would intersect the center of top weight member 24. The terminating ends of pins 33 and 34, depending on which direction the leverage weight 31 is placed on the core 22, extend out to the surface of the bowling ball 10, and can be color coded such that they are visible. Similarly, a color code pin 38 is placed on the centermost portion of the axis weight member 30 and also extends to the outside surface of bowling ball 10. These color coded pins aid the mechanic in drilling holes on the ball 10. Referring to FIG. 1, the core member 20 is rotated 40° to 50°, shown is the angle alpha, counterclockwise from the horizontal line 52 defining an axis line 50, such that the center of axis weight member 30 is 40° to 50° away from the horizontal line 52. This places the axis weights 30 and 40 in a position such that the ball 10, when thrown, has better trajectory. In the event the bowler wants a ball with the leverage weight 31 out, the wider portion of the leverage weight 31 would be placed on the core such that the wider portion of weight 31 is facing towards the outer shell. This results in more weight applied towards the outer surface which provides better impact. In the event a bowler desires a smoother rolling ball, the leverage weight 31 is set on the core such that the wider portion of the weight 31 is immediately adjacent the core member 22.

As previously mentioned, pin 38 located on axis weight member 30 is used to aid the bowling ball mechanic, i.e., the person who is drilling the finger holes, to determine where the axis weight 30 and leverage weight 31 are located. The pin 38 will usually be of a different color than that of the ball so that it can be seen on the ball surface by the bowling ball drilling mechanic.

Figure 2:
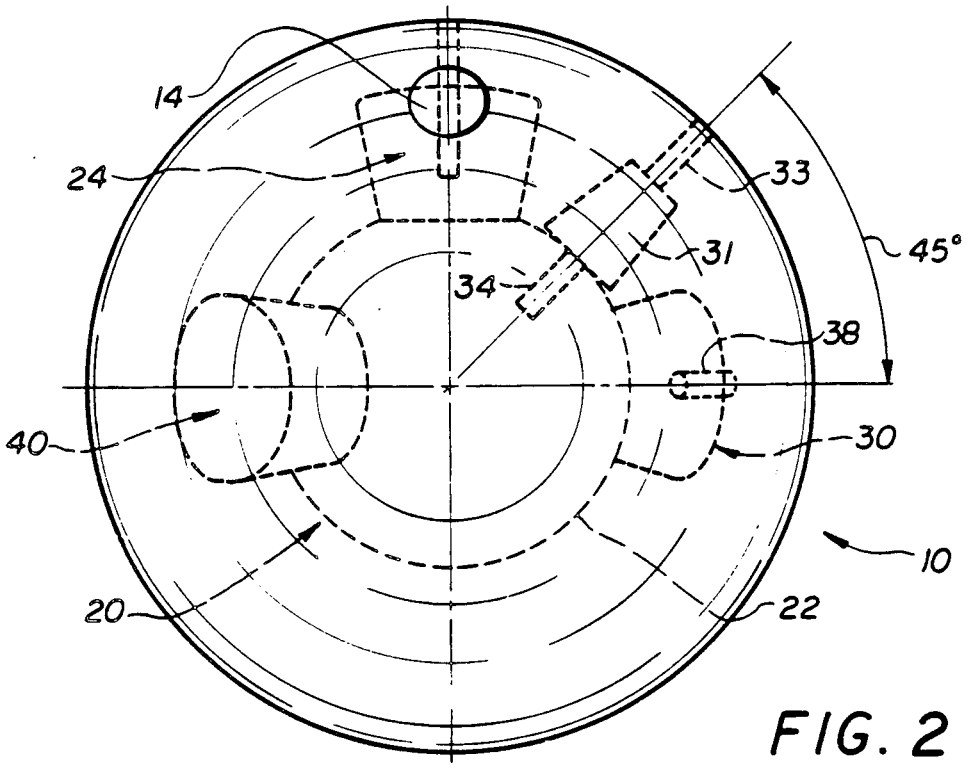
FIG. 2 represents a front view of the bowling ball illustrated in FIG. 1.

As previously mentioned, the bowling ball 10 just described and shown in FIGS. 1 and 2 is designed for heavy oil conditions. As shown, the leverage weight member 31 is placed on the core 22 such that the heavier portion of the weight is closer to the center of the ball as opposed to the outer part of the ball. With the leverage weight in this position, the ball will have a smoother rolling pattern. With the leverage weight 31 reversed, the ball will produce more pin action at impact.

Figure 11:
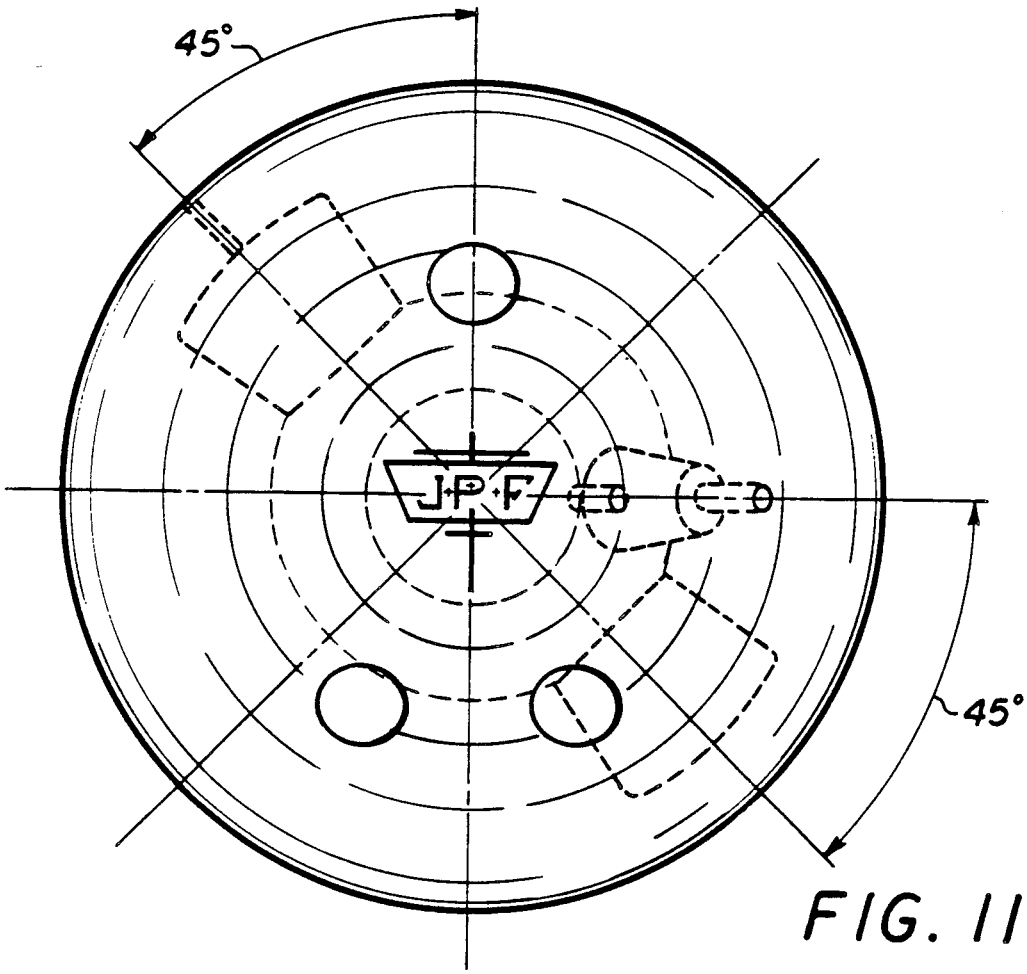
FIG. 11 represents the top view of a bowling ball with a bowling ball insert including leverage weight, axis and power drive weights designed for left-handed bowlers.
Figure 12:
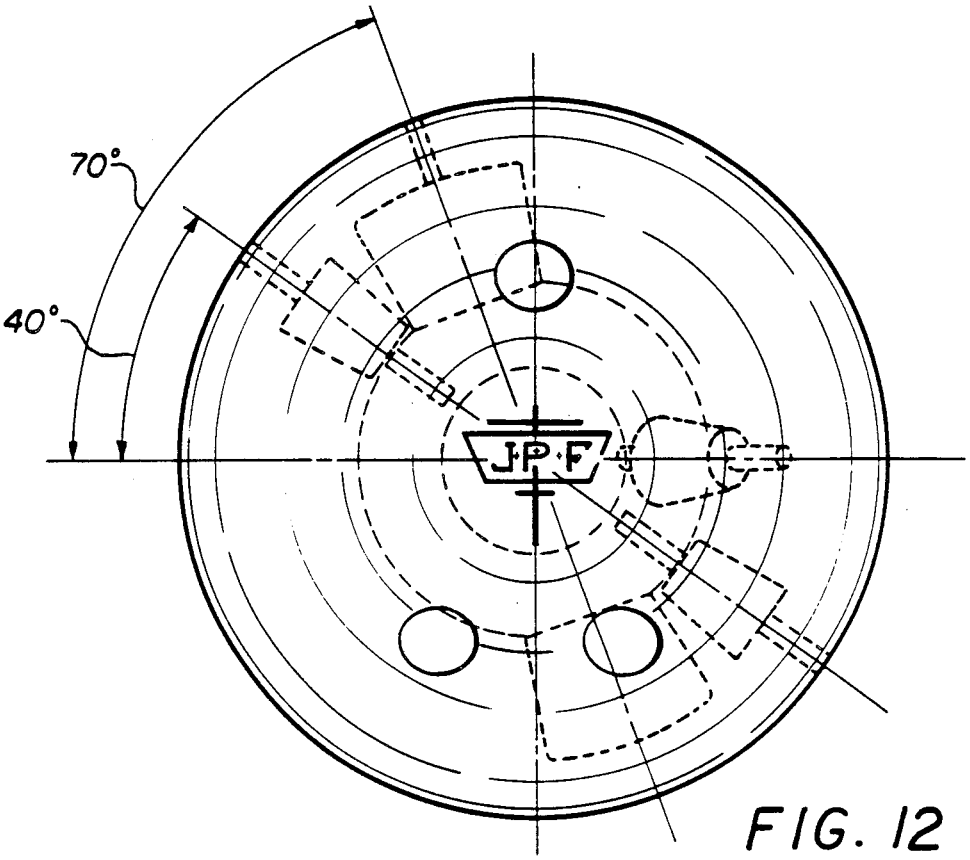
FIG. 12 represents the top view of a bowling ball with a bowling ball insert including four leverage weights.
Figure 13:
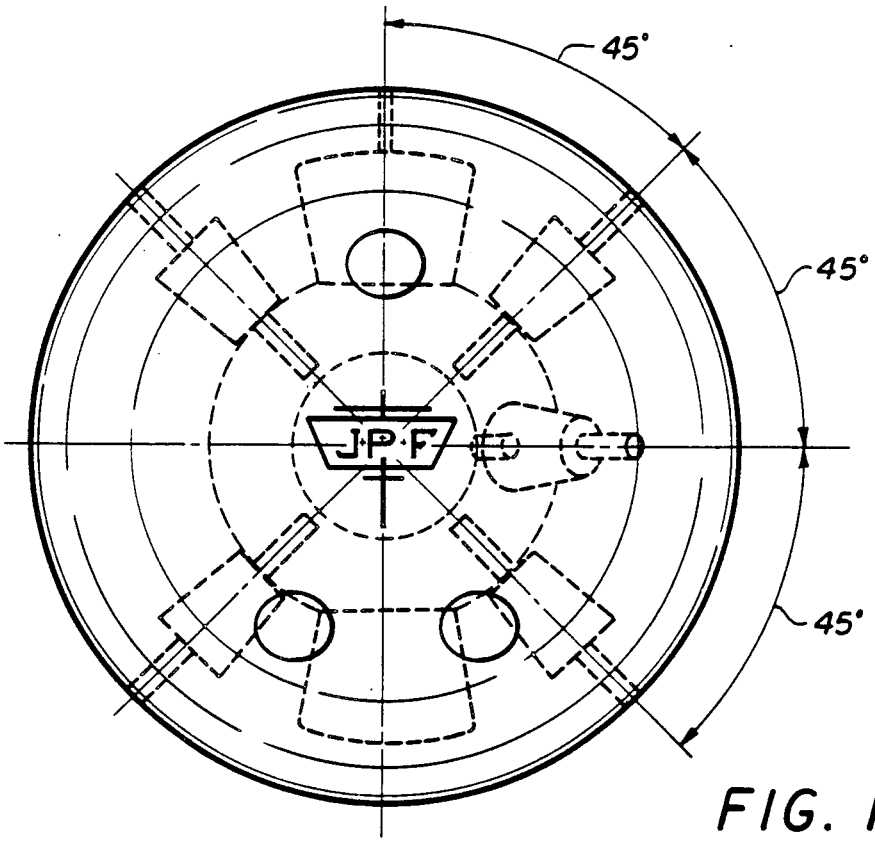
FIG. 13 represents the top view of a bowling ball with a bowling ball insert including four leverage weights.

The core member 22 and all of the attached components can be fabricated from any strong non-metallic material such as barium oxide. The bowling ball 10 as described is for a right hander. To drill it for a left hander, all the mechanic need do is reverse the drilling procedure such that the finger holes 14 are placed on the ball 10 as shown in FIGS. 11, 12 and 13.

Figure 6:
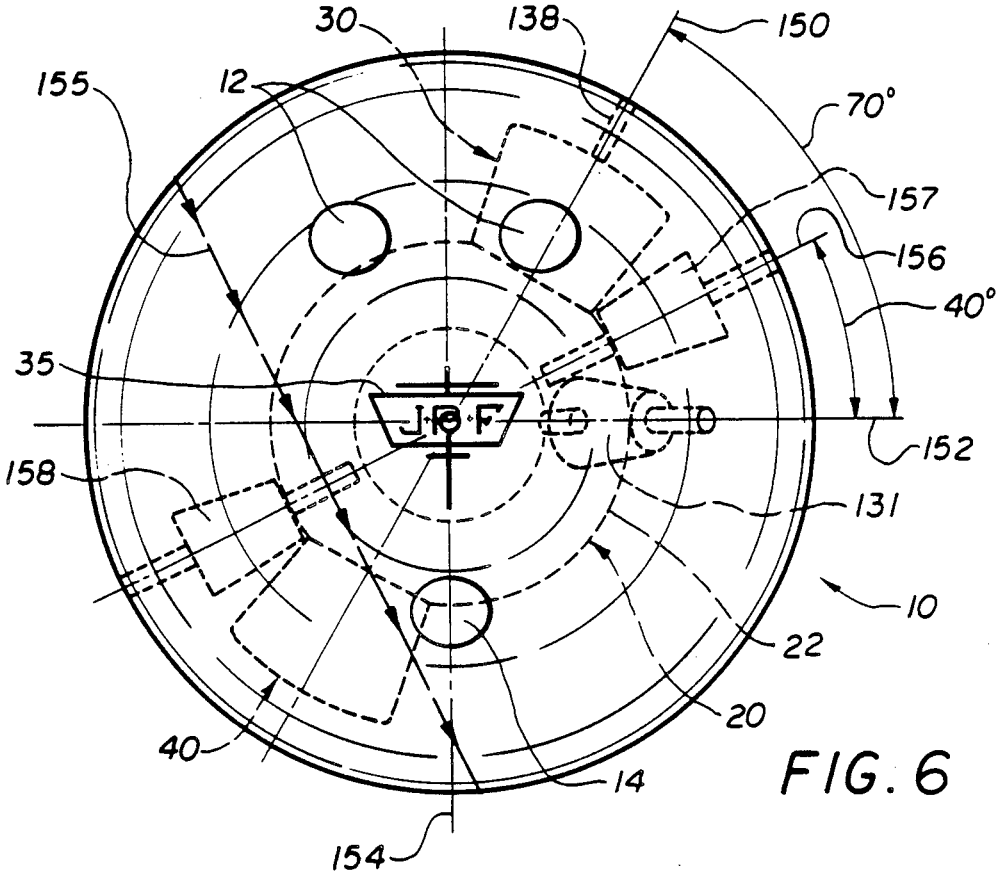
FIG. 6 represents a top view of yet another embodiment of a bowling ball illustrating a plurality of power, axis and leverage weights.
Figure 7:
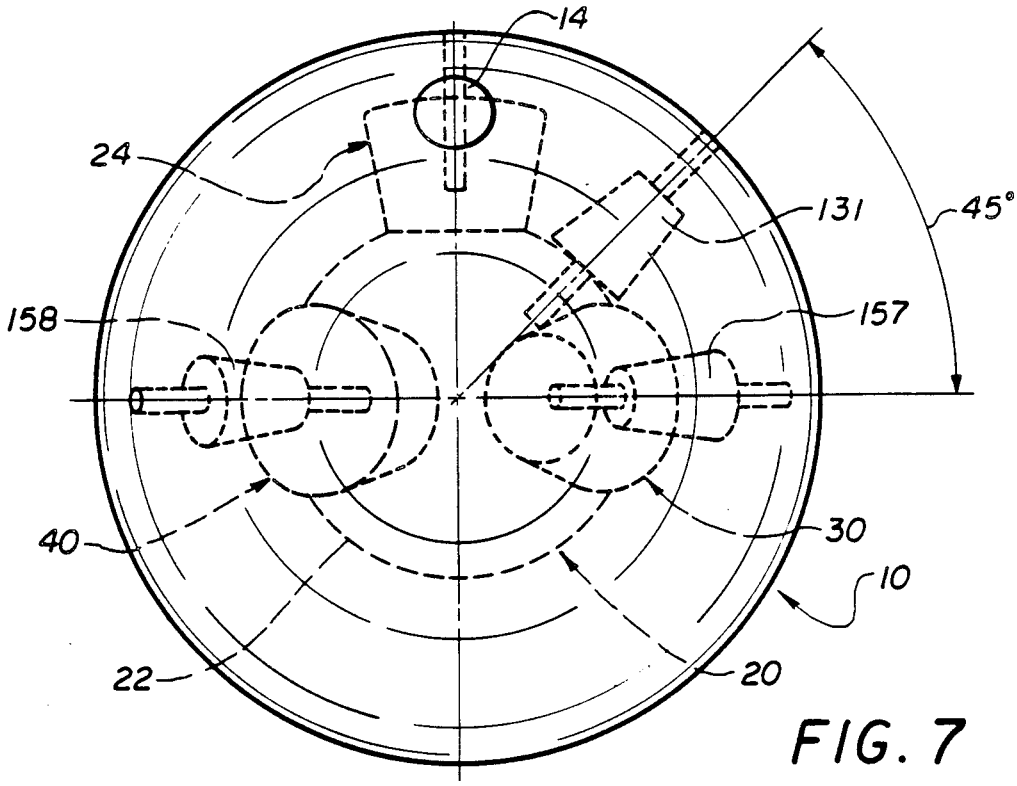
FIG. 7 represents a front view of the bowling ball illustrated in FIG. 6.

Referring now to FIGS. 6 and 7, there is illustrated a ball designed for average or medium oil conditions. The core member 20 is now rotated 60° to 70° counterclockwise from the horizontal line 152 such that the pin 138 located on the extending weight 30 is 60° to 70° away from the horizontal line 152. Leverage weight 131 is placed on the core 22 along the plane described by horizontal line 152 generally equidistant between weight members 24 and 30.

Moving counterclockwise from horizontal line 152, at an angle of approximately 40°, a leverage weight line 156 is described such that weights, now 157 and 158, are placed on the core 22 on the line described by line 156 and in the horizontal plane described by weights 30 and 40. In the configuration just described, the weights 30 and 40 now become power drive weights, weights 157 and 158 now act as axis weights and the weight 131 now is the leverage weight. Perpendicular to line 152 at the center rhombus 35 is line 154. It can be seen that the bowling ball grip is generally perpendicular to the line 152. In this embodiment leverage weight has been added to the ball, however, because of the power drive weights 30 and 40, the ball will travel further down the lane before breaking into a hook; therefore, ideal for an alley with average or medium oil.

Figure 8:
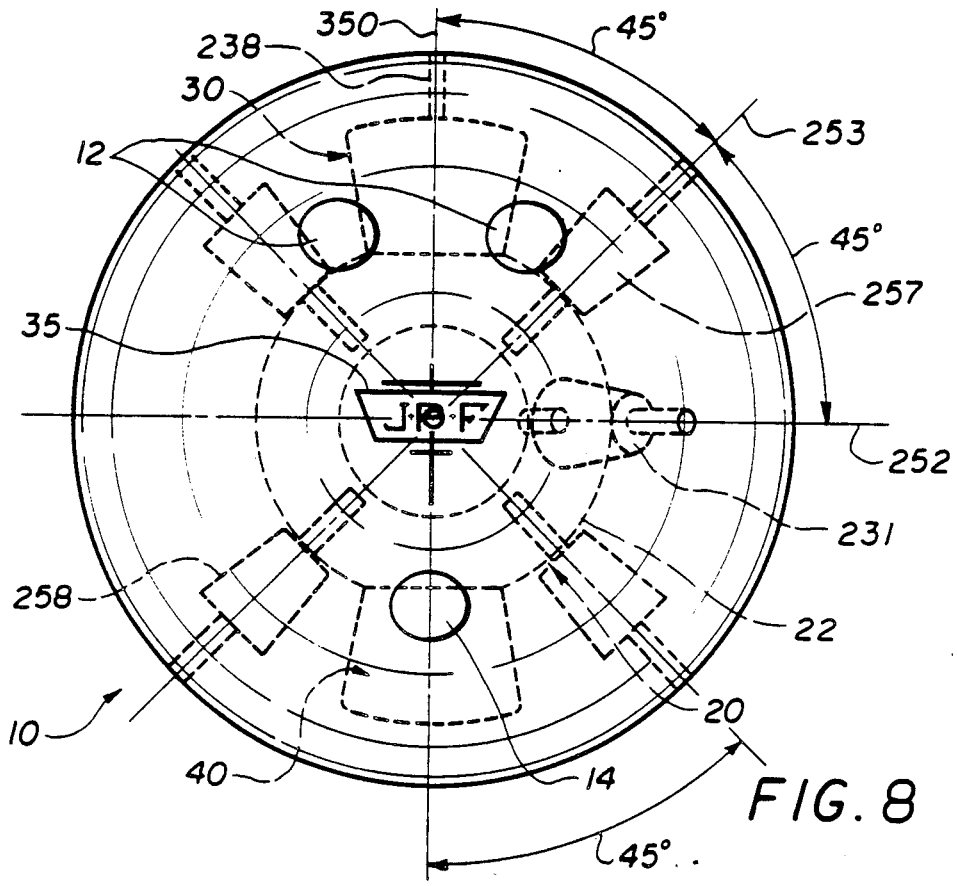
FIG. 8 represents a third embodiment of a bowling ball illustrating a plurality of power, axis and leverage weights.
Figure 9:
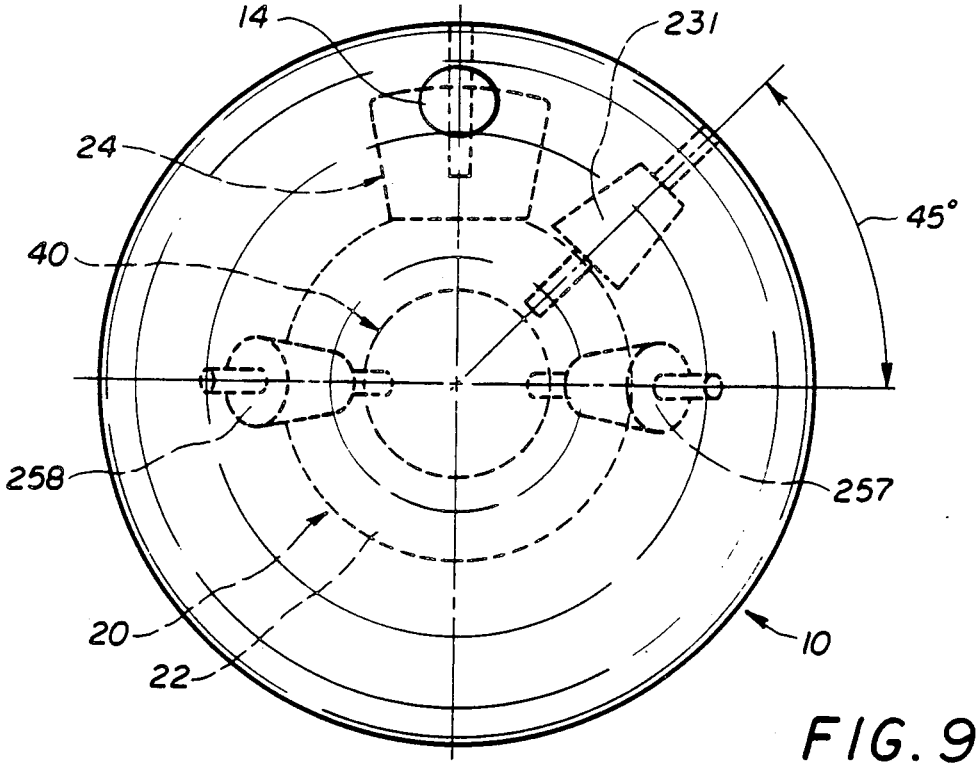
FIG. 9 represents a side elevation view of the bowling ball illustrated in FIG. 8 including axis, leverage and power drive weights.

There is illustrated in FIGS. 8 and 9 a bowling ball designed for short oil. Short oil is an alley condition in which the bowler wants a late roll, i.e., you want the ball to travel down a good portion of the alley before allowing the ball to obtain ultimate roll and drive into the pocket.

Referring now to FIGS. 8 and 9, it can be seen that the core member 20 has now been rotated 80° to 90° counterclockwise from the horizontal line 252 which is coincident with the longitudinal axis defined by the trademark rhombus 35. Leverage weight 231 is placed on the core 22 along the line described by horizontal line 252, and in a plane generally equidistant between weights 24 and 30 as described in the two previous embodiments.

Moving counterclockwise from horizontal line 252 at an angle of approximately 40° to 50° there is defined an axis weight line 253. Weights 257 and 258 are placed on the core 22 in the plane described by line 253, generally adjacent weights 30 and 40. Weights 30 and 40 will now be referred to as pin drive weights and are positioned on line 350 which is perpendicular to line 252. Because of the location of the weights 30 and 40 with respect to the horizontal line 252, weights 257 and 258 now become the axis weights. The ball just described allows the ball to roll further down the alley before hooking. Again, it can be seen that the ball grip is essentially perpendicular to line 252. In the event the bowling ball in FIG. 8 were to be drilled for a left-hander, weights 276 and 278 would now be the leverage weights.

It is also noted that in all the embodiments, the leverage weight is always perpendicular to the grip line and also, that placing the weights closer to the outside surface of the shell produces a ball with better impact and placing the weights away from the outer shell produces a smoother rolling ball.

Pins 38, 138 and 238 are used, but not always necessarily, to hold the core 20 in the mold before pouring the outside shell. Also, as mentioned previously, the pins are also used to identify where the weights 30 and the leverage weights are located. This is important for proper drilling of the finger and thumb holes. The core member 20 as well as the weights can be manufactured from any strong non-metallic material such a barium oxide.

In bowling, there are a plurality of types of ways to throw a ball; for instance, a bowler can throw a full roller, in which the track of the ball lies between the thumb hole and finger holes. Another would be a high roller which makes a track approximately ¾ of the ball diameter such as shown in FIG. 6, as line 155. It can be seen that the track 155 lies to the left of the thumb hole 14 and finger hole 12 as the ball 10 rotates in the direction of thumb hole 14. As the ball 10 rotates, it can be seen that the track 155 is approximately perpendicular to the line 156 and the reason for this is the effect of the pin side member 30 working in conjunction with the non-pin side member 40, the axis weight and leverage weight. At the time the ball 10 is released down the alley, the top extending member 24, which is heavier than extending members 30 and 40, places a little more weight to the top of the ball. This gives the ball increased rotation, or said another way, gives the ball 10 more revolutions as the ball travels down the alley which gives the ball extra impact when the ball 10 makes contact with the pins.

FIGS. 11, 12 and 13 illustrate a ball 10 which is drilled for a left-handed bowler. It can be seen that the finger holes and thumb hole are simply reversed from those shown in FIGS. 1 and 2 and the other two embodiments. FIGS. 11, 12 and 13 have not been numbered inasmuch as the ball is a mirror image of the ball previously described, with one exception; the embodiments illustrated in FIGS. 12 and 13 illustrate the use of additional weights of the type shown in FIG. 10. Again the number of weights depends on the type of bowling ball that the user wants, however, the number of weights does not change the objective of the ball.

Although the invention has been described as having frusto-conical shaped members integral to a sphere, it is noted that the invention could work with other shaped extending members such as elliptical, cylindrical, rectangular, etc. The important thing is that the core member not interfere with a smooth roll. The smooth roll adds to the efficiency of the ball upon impact with the pins. It is also noted that this invention may be embodied in other specific forms without departing from the spirit thereof. The preferred embodiment illustrated herein is therefore to be considered in all respects as being illustrative and not restrictive, the scope of the invention being indicated by the appended claims, rather than by the foregoing specification.

What is claimed is:

1. A bowling ball having a top side, positive side and negative side comprising:

a core member including a top weight member, two axis weight members, all generally lying in the same plane, and at least one leverage weight member, said leverage weight member located generally adjacent one of said axis weight members, said top weight member and said axis weight members being generally of uniform size and having generally similar geometric structure, said leverage weight member generally being smaller in size with respect to said top weight member and said axis weight members, and an outer shell member, said shell member encapsulating said core member, top weight member, axis weight member and said leverage weight member, said core member being located generally near the geometric center of said outer shell member, said location determined by the weight desired at the top of the ball.

2. A bowling ball according to claim 1, wherein said axis weight members are spaced apart from each other, wherein said axis weight members are disposed generally opposite each other and equally disposed from said top weight member.

3. A bowling ball according to claim 2 wherein said top weight member and said axis weight members are frusto-conical in configuration, said axis weight members being disposed on the positive side and negative side of the ball.

4. A bowling ball according to claim 3 wherein said leverage weight member is disposed generally adjacent said axis weight located on the positive side and below said top weight.

5. A bowling ball according to claim 4 wherein said leverage weight member being disposed 40° to 50° clockwise from the geometric center of said axis weight on the positive side of the ball.

6. A bowling ball according to claim 5 wherein two additional weights are disposed on said core member, said additional weights being similar in construction to said leverage weight and being disposed, in a spaced relationship, generally opposite each other and at an angle of approximately 40° counterclockwise with respect to said leverage weight, and being further disposed in a plane generally coincident a longitudinal axis defined by said axis weights.

7. A bowling ball having a top side, positive side and negative side comprising:

a core member including a top weight member, two axis weight members, all generally disposed in the same plane, a plurality of leverage weight members, wherein one of said leverage weight members is disposed along a horizontal line at a distance generally equal between said top weight member and one of said axis weight members and wherein at least two of said leverage weight members are disposed generally opposite each other at an angle ± alpha from said previously disposed leverage weight member, said top weight member and said axis weight members being generally of uniform size and having generally similar geometric structure, said leverage weight member generally being smaller in size with respect to said top weight member and said axis weight members, and an outer shell member, said shell member encapsulating said core member, top weight member, axis weight member and said leverage weight member, said core member being located generally near the geometric center of said outer shell member, said location determined by the weight desired at the top of the ball.

8. A bowling ball according to claim 7 wherein said top weight member and said axis weight members are frusto-conical in configuration, said axis members being disposed opposite each other vertically equidistant from said top weight member and generally adjacent said two axis weight members.

9. A bowling ball according to claim 8 wherein said leverage weight member being disposed ±40° to ±50° clockwise from the geometric center of said axis weight on the positive side of the ball.

10. A bowling ball having a top side, positive side and negative side comprising:

a spherical core member including a top weight member, two axis weight members, all having the configuration of a frusto-cone, and all being disposed on the same plane such that the top weight member is disposed vertically above said two axis weight members which are disposed opposite each other along an axis defined by the center of said spherical core member, a plurality of leverage weight members, wherein a first leverage weight member is disposed along a horizontal line at a distance generally equal between said top weight member and one of said axis weight members and wherein at least a second and third leverage weight member are disposed opposite each other at an angle ± alpha from said first leverage weight member, said top weight member and said axis weight members being generally of uniform size and having generally similar geometric structure, said leverage weight member generally being smaller in size with respect to said top weight member and said axis weight member, and an outer shell member, said shell member encapsulating said core member, top weight member, axis weight member and said leverage weight member, said core member being located generally near the geometric center of said outer shell member, said location determined by the weight desired at the top of the ball.

* * * * *